US007805967B1

(12) United States Patent
Agozzino et al.

(10) Patent No.: US 7,805,967 B1
(45) Date of Patent: Oct. 5, 2010

(54) UNIVERSAL DEADBOLT LOCK KNOB IMMOBILIZER

(75) Inventors: Andrew Agozzino, Tamarac, FL (US); Domenic Mucciacciaro, Boca Raton, FL (US)

(73) Assignee: Lok-A-Bolt Corp., Deerfield Beach, FL (US)

( * ) Notice: Subject to any disclaimer, the term of this patent is extended or adjusted under 35 U.S.C. 154(b) by 0 days.

(21) Appl. No.: 12/592,887

(22) Filed: Dec. 4, 2009

(51) Int. Cl.
*E05B 13/08* (2006.01)

(52) U.S. Cl. ..... 70/211; 70/416

(58) Field of Classification Search ..... 70/416, 70/429, 430, 202, 211; D8/330, 331, 343, D8/346; 292/258, 288, 289, 291, 292
See application file for complete search history.

(56) References Cited

U.S. PATENT DOCUMENTS

| | | | | | |
|---|---|---|---|---|---|
| 840,711 | A | * | 1/1907 | Puttcamp et al. | 70/429 |
| 921,390 | A | * | 5/1909 | Finn | 70/429 |
| 979,331 | A | * | 12/1910 | Odenz | 70/429 |
| 1,000,194 | A | * | 8/1911 | Prescott | 70/430 |
| 1,055,510 | A | * | 3/1913 | Birkle, Jr. | 70/429 |
| 1,287,316 | A | * | 12/1918 | Holzinger | 70/429 |
| 1,343,615 | A | * | 6/1920 | Caralun | 70/429 |
| 1,700,135 | A | * | 1/1929 | Lanes | 70/416 |
| 2,463,195 | A | * | 3/1949 | Mungan | 70/416 |
| 3,263,462 | A | * | 8/1966 | Suroff et al. | 70/447 |
| 3,585,827 | A | | 6/1971 | Dominguez | |
| 3,933,014 | A | | 1/1976 | Moses | |
| 4,185,483 | A | | 1/1980 | Lupton | |
| 4,279,137 | A | | 7/1981 | Cook | |
| 4,715,200 | A | | 12/1987 | Kasaros | |
| 5,000,498 | A | | 3/1991 | Upchurch | |
| 5,003,803 | A | * | 4/1991 | Richards | 70/416 |
| 5,007,263 | A | | 4/1991 | Taylor | |
| 5,035,128 | A | | 7/1991 | Ridgway | |
| 5,052,202 | A | * | 10/1991 | Murphy | 70/211 |
| 5,067,334 | A | * | 11/1991 | Sorkilmo | 70/416 |
| 5,462,322 | A | | 10/1995 | Bergzansky | |
| 5,515,704 | A | | 5/1996 | van Nguyen | |
| D397,025 | S | * | 8/1998 | Kosi | D8/343 |
| 5,950,465 | A | * | 9/1999 | Schultz et al. | 70/416 |
| 6,324,879 | B1 | | 12/2001 | Kennedy | |
| 6,332,344 | B1 | | 12/2001 | Montoya | |
| 6,742,369 | B1 | | 6/2004 | Veillette | |
| 6,993,944 | B2 | | 2/2006 | Hicks | |
| 7,144,052 | B1 | * | 12/2006 | Kent et al. | 292/288 |
| 7,216,903 | B1 | * | 5/2007 | Kent et al. | 292/288 |
| 7,284,400 | B1 | | 10/2007 | Agozzino | |
| 2005/0193787 | A1 | | 9/2005 | Davis | |
| 2007/0033973 | A1 | | 2/2007 | Kosi | |
| 2007/0107479 | A1 | * | 5/2007 | Robertson | 70/416 |

* cited by examiner

*Primary Examiner*—Lloyd A Gall
(74) *Attorney, Agent, or Firm*—Alvin S. Blum

(57) ABSTRACT

Apparatus is simply hung on a deadbolt knob when the deadbolt is in locked position. It prevents the deadbolt knob from rotating enough to retract the deadbolt. This ensures that the door cannot be unlocked from the outside. A passage in an upper end of the apparatus is dimensioned to receive the deadbolt knob. The deadbolt knob is not round. The passage has side walls narrow enough to prevent the deadbolt knob from rotating freely within the passage. As the knob is rotated, the knob engages the side walls of the passage so that the entire apparatus rotates until the lower end of the apparatus engages the door frame. Many passages are provided so that the apparatus may be used with deadbolt knobs that have different locked positions.

2 Claims, 5 Drawing Sheets

PRIOR ART 1
2
3
4
14

UNIVERSAL DEADBOLT LOCK KNOB IMMOBILIZER

FIELD OF THE INVENTION

This invention relates generally to door locking mechanisms, and more specifically to a portable, easily installable and removable door locking device that prevents operation of the deadbolt lock mechanism.

BACKGROUND OF THE INVENTION

It is well known in the art to provide a door with a deadbolt lock. Such locks are generally provided where security is a concern, such as the door of a home, business, or hotel room. The deadbolt is mounted above the usual doorknob that actuates the less secure spring loaded latch. The deadbolt lock is operable by a key on the outside. It may be operable without a key on the inside by a simple knob. This enables escape in an emergency without a key. The knob is elliptical in shape so that a user can visually determine whether the deadbolt is locked or unlocked. The long axis of the ellipse is generally vertical when the bolt is in the locked position. When a person is secure behind a deadbolt locked door, that security may be breached by someone with a key, or someone with means to retract the bolt.

U.S. Pat. No. 7,284,400 issued Oct. 23, 2007 to one of the applicants discloses a device to further ensure that someone with a key or other means to operate the deadbolt could not move the bolt enough to open the door. A first end of the device has a passage to receive the deadbolt knob when the bolt is in locked position and the long axis is vertical. As the knob is rotated, the device is so shaped and dimensioned that it also is rotated, until a portion of the device is forced against a rigid element, such as the door frame, or jamb, that prevents further rotation. Unfortunately, there are deadbolts that do not present the long axis of the knob in vertical position when the bolt is in locked condition. The long axis of the knob may be horizontal or plus or minus 45 degrees from the vertical when in locked condition. In many of those situations, the device of the prior art will not function. Another problem is encountered with some doors that swing inward to open. When they have a thick bezel at the base of the deadbolt lock knob, the bezel may hold the device of the prior art off the door surface far enough that it swings past the door frame, thereby allowing the deadbolt to open.

SUMMARY OF THE INVENTION

It is accordingly an object of the invention to provide a device that can be simply hung on the deadbolt knob that will prevent the knob and the bolt connected thereto from operating. A first end of the device has a plurality of passages to receive the deadbolt knob when the locked condition presents the long axis of the knob vertical, horizontal, or 45 degrees from the vertical. As the knob is rotated, the device is so shaped and dimensioned that it also is rotated, until a portion of the device is forced against a rigid element that prevents further rotation. The device may be provided with means for storing in an inactive mode at the door, so that it is readily available when needed.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not limitation.

Figure 1:
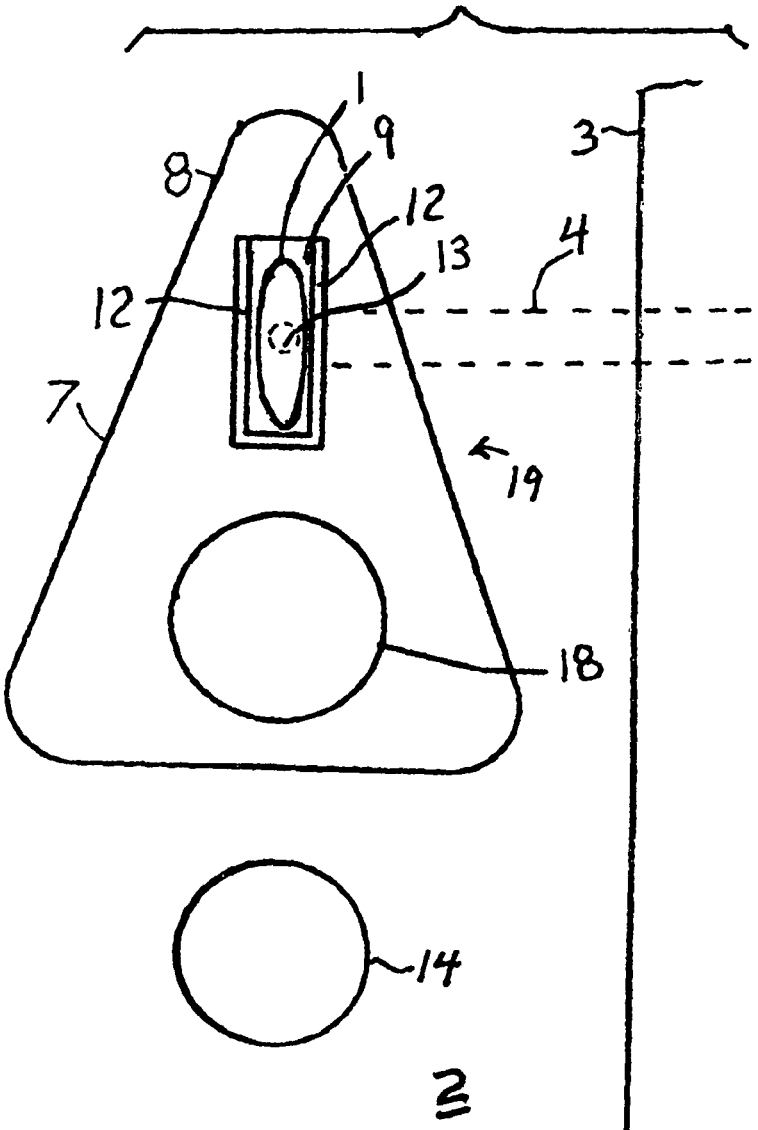
FIG. 1 PRIOR ART
FIG. 1 is a front elevation view of the device of the prior art in use.
Figure 2:
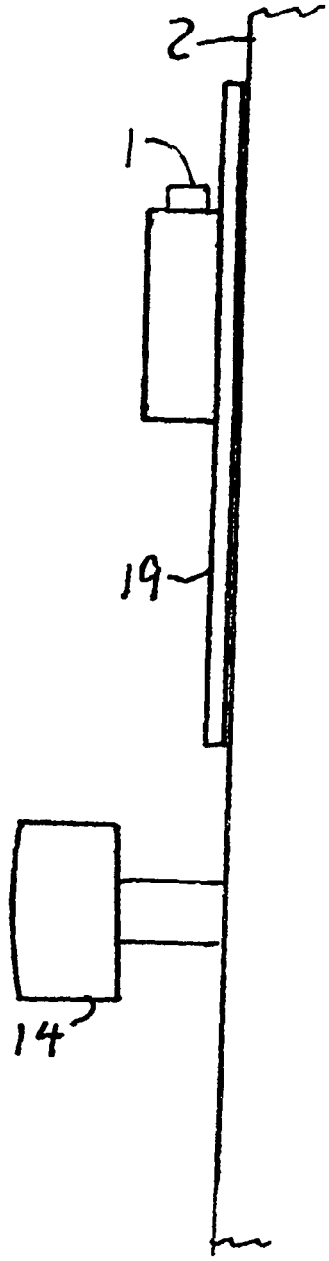
FIG. 2 PRIOR ART
FIG. 2 is a side view of the device of FIG. 1.

Referring now first to the drawing FIG. 1, of the prior art, a portion of the interior side of a conventional door 2 mounted in a frame 3 has a doorknob 14 and a deadbolt 4 that is operated by rotation of a key (not shown) on the exterior side of the door and/or a deadbolt knob 1 on the interior side of the door. The deadbolt knob 1 is operationally linked to the deadbolt, so that the deadbolt cannot move if the knob 1 is prevented from rotating. A deadbolt knob immobilizing apparatus 19 of the prior art may be removably mounted on the deadbolt knob 1 so as to prevent rotation of the knob and also of the deadbolt to which it is linked. This ensures that the deadbolt cannot be retracted (unlocked) by a key on the outside, or by an intruder with burglary tools. FIG. 2 is a side view of FIG. 1. After the device is mounted on the knob 1, the weight of the device will cause it to drop down onto the deadbolt knob shaft 13, shown in phantom. This has the advantage that banging on the door cannot dislodge the device.

The apparatus 19 of the prior art comprises an elongate body 7 with a through passage 9 at a first end 8. The passage is constructed and dimensioned to readily receive the deadbolt knob 1 therein. Deadbolt knobs 1 have a long first dimension, and a shorter second dimension orthogonal to the first dimension. The passage 9 has side walls 12 that are spaced apart a greater distance than the second dimension of the knob 1 and a lesser distance than the first dimension of the knob 1 so that the knob cannot rotate freely within the passage. When the knob 1 is rotated, it engages a sidewall 12 that causes the entire apparatus 19 to rotate. The second end of the body is rotated until it engages the fixed door frame 3. This immobilizes the deadbolt knob, preventing further rotation of knob 1 and retraction of deadbolt 4. For convenience of storage of the apparatus when not operational, an aperture 18 is provided in the second end 15. This is dimensioned to slip over the doorknob 14. When hanging there, it does not interfere with door operation.

Figures 3, 4, 5, 6:
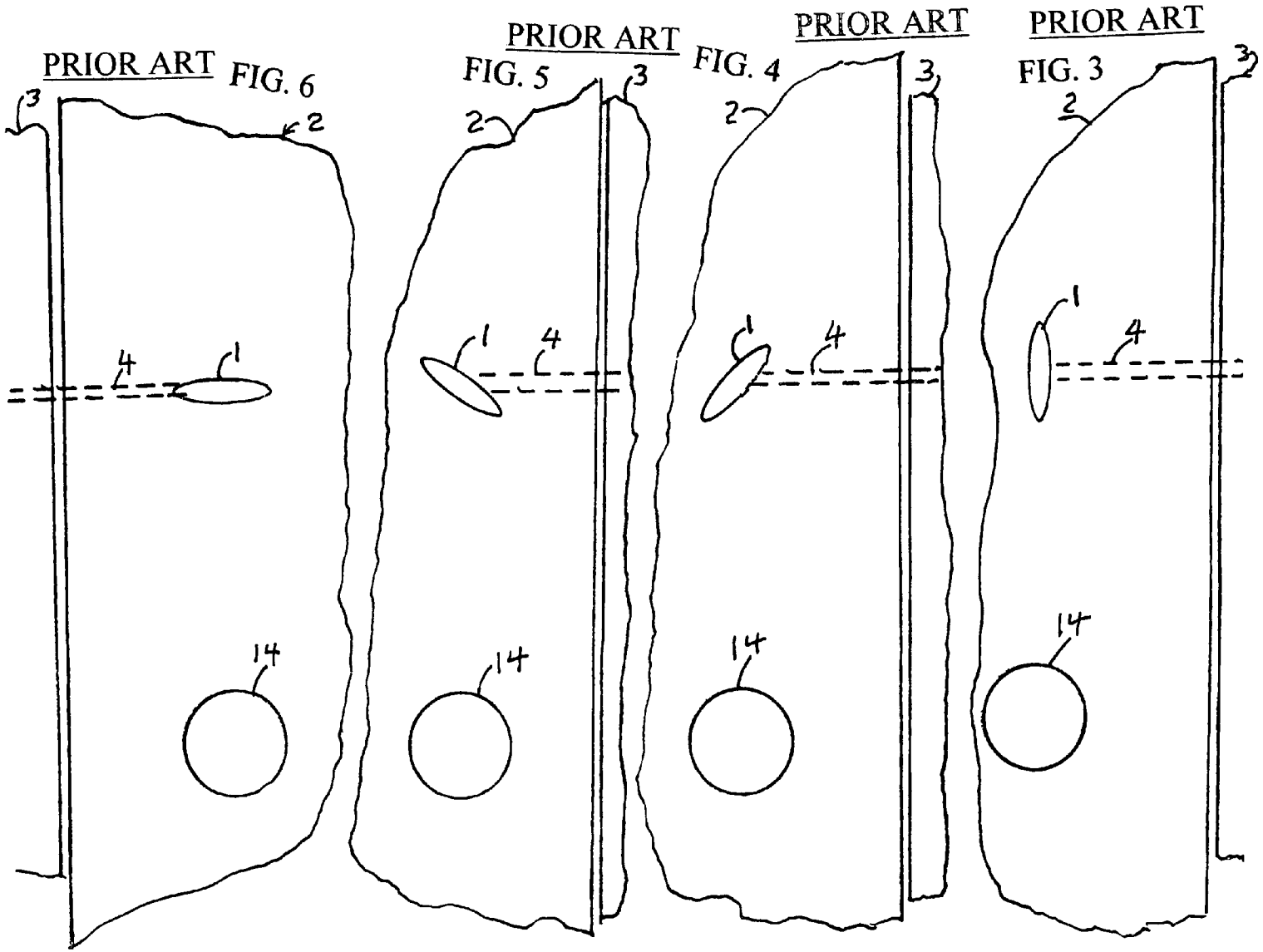
FIG. 3 PRIOR ART
FIG. 4 PRIOR ART
FIG. 5 PRIOR ART
FIG. 3 is a front elevation view of many doors in common use.
FIG. 4 is a front elevation view of many doors in common use.
FIG. 5 is a front elevation view of other doors in use.
FIG. 6 is a front elevation view of other doors in use.
Figure 7:
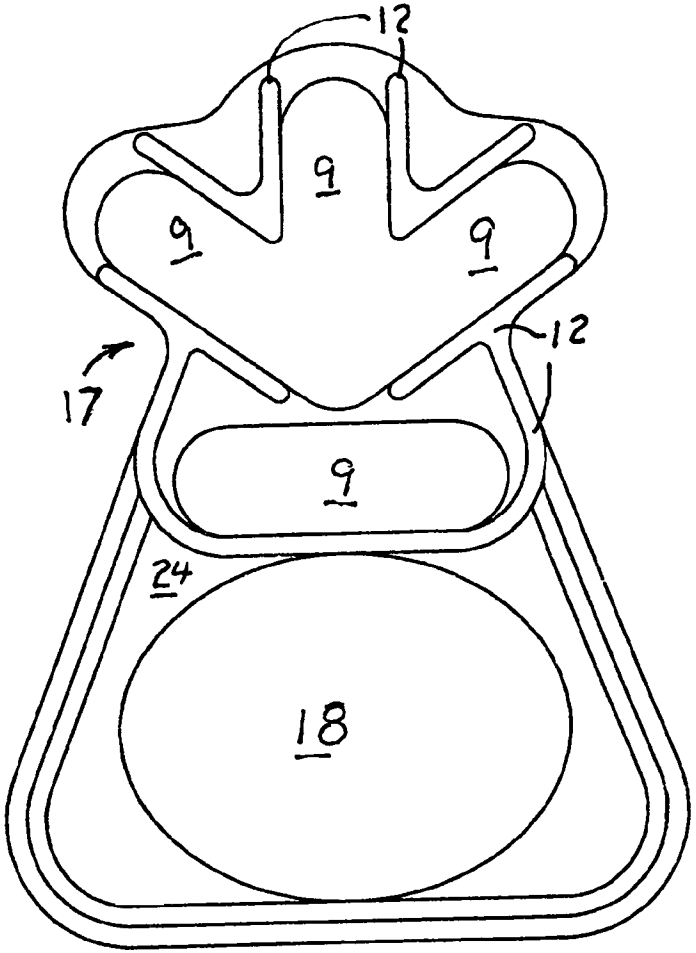
FIG. 7 is a front elevation view of the instant invention.
Figure 8:
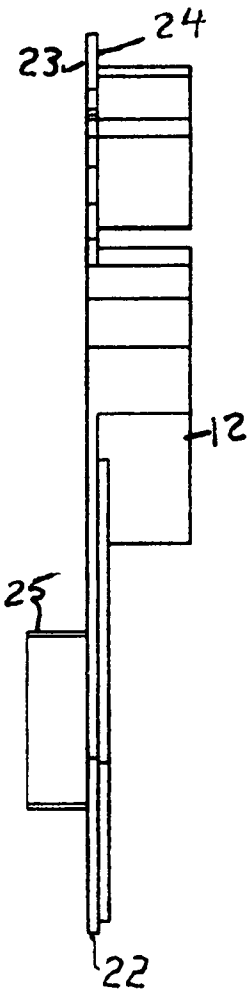
FIG. 8 is a side view of the invention.

However, only when the deadbolt knob is vertical, as shown in FIG. 3, when in locked condition, will the device 19 operate effectively. Although this is a usual configuration, not all doors have that configuration. FIGS. 4, 5, and 6 show configurations of the deadbolt knob 1 when the deadbolt 4 is in locked condition that may be found in use. Furthermore, some deadbolt assemblies come with a bezel 16 that is so thick that it pushes the device 19 away from the face of the door. This is not a problem with exterior doors that swing out. It may be a problem with doors that swing inwardly to open. In that case, there is no jamb in place, and the frame may not extend inwardly enough to engage the device as it rotates with the knob 1. Consequently, there is no obstruction to knob rotation, and retraction of the bolt.

Figure 9:
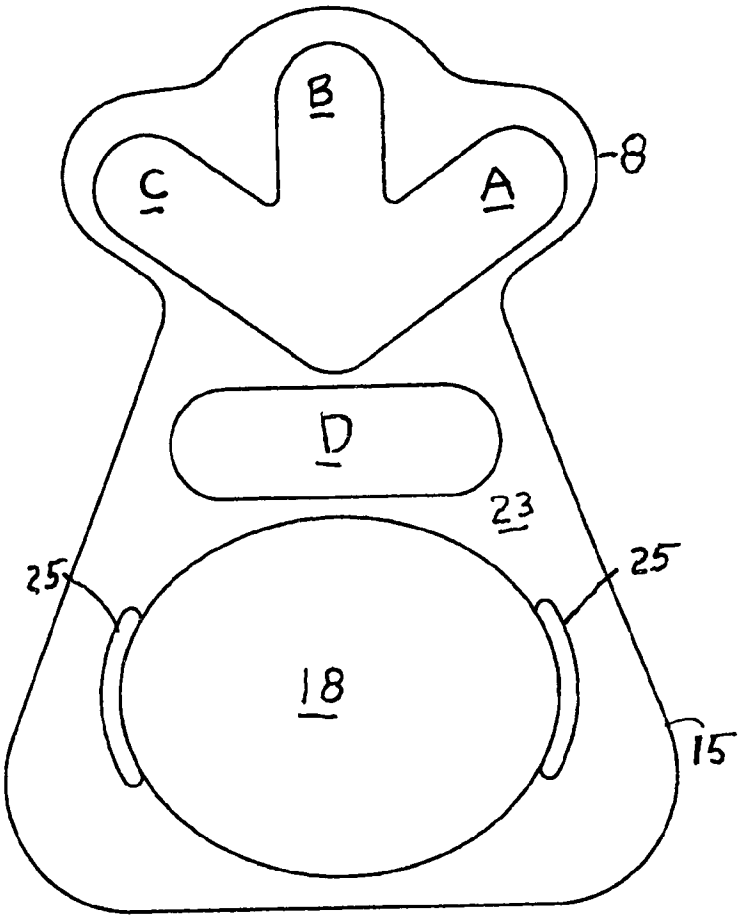
FIG. 9 is a rear view of the invention.
Figure 11:
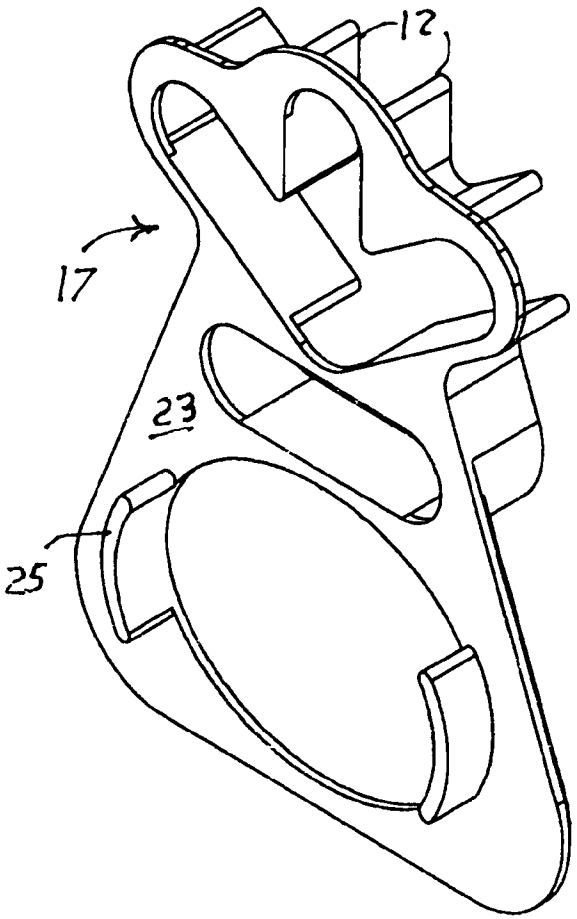
FIG. 11 is a rear isometric view of the invention.
Figure 10:
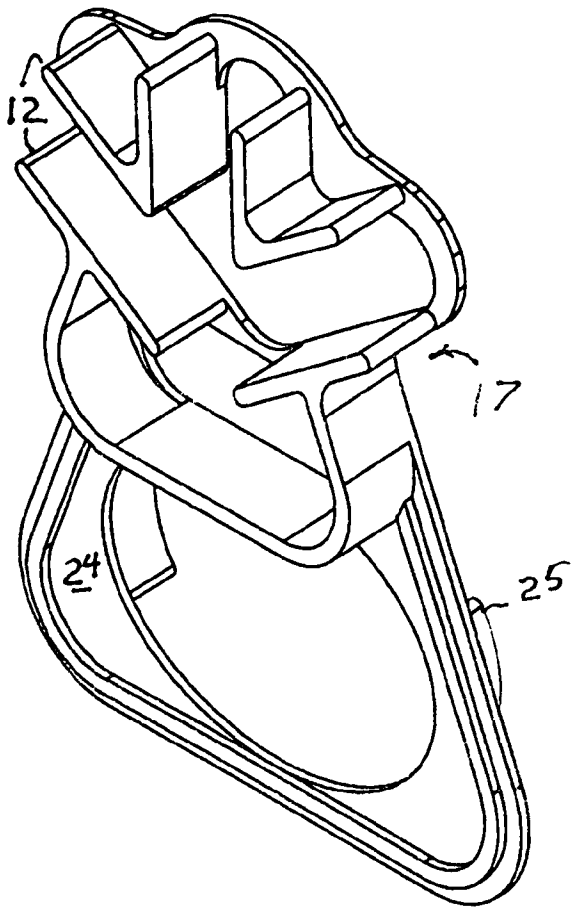
FIG. 10 is a front isometric view of the invention.

Referring now to FIGS. 7-13, the instant invention provides a single device 17 with no moving parts that can be used with any of the door configurations shown in FIGS. 3-6. Apparatus 17 of the invention is a monolithic device having an elongate planar body 22 with a broad first face 23 and an opposed second broad face 24. A plurality of through passages 9, at a first end 8 of the planar body, are dimensioned to removably receive therein the deadbolt knob 1. The four passages 9 are oriented so that when the knob 1 is in any one of the locked positioned shown in FIGS. 3-6, there will be a passage that will receive the knob 1 while the lower end 15 is down, away from frame 3, and will engage the frame as the knob is turned before the bolt is retracted. As shown in FIG. 9, passage A will work with the FIG. 5 configuration; passage B will work with FIG. 3 configuration; passage C will work with FIG. 4 configuration; and passage D will work with FIG. 6 configuration. Sidewalls 12 extend outwardly from the first face 24 on either side of the long dimension 21 of each passage 9. The sidewalls 12 are spaced apart a greater distance than the second dimension 6 of the knob 1 and a lesser distance than the long first dimension 5 of the knob so that the knob cannot rotate freely within the passage. When the knob 1 is rotated by turning a key in the door exterior, the body is rotated until the lower end 15 engages the fixed door frame 3. This immobilizes the deadbolt knob, preventing further rotation of knob 1 and retraction of deadbolt 4. For convenience of storage of the apparatus when not operational, a through aperture 18 is provided in the second end 15. This is dimensioned to slip over the doorknob 14. When hanging there, it does not interfere with door operation.

Figure 12:
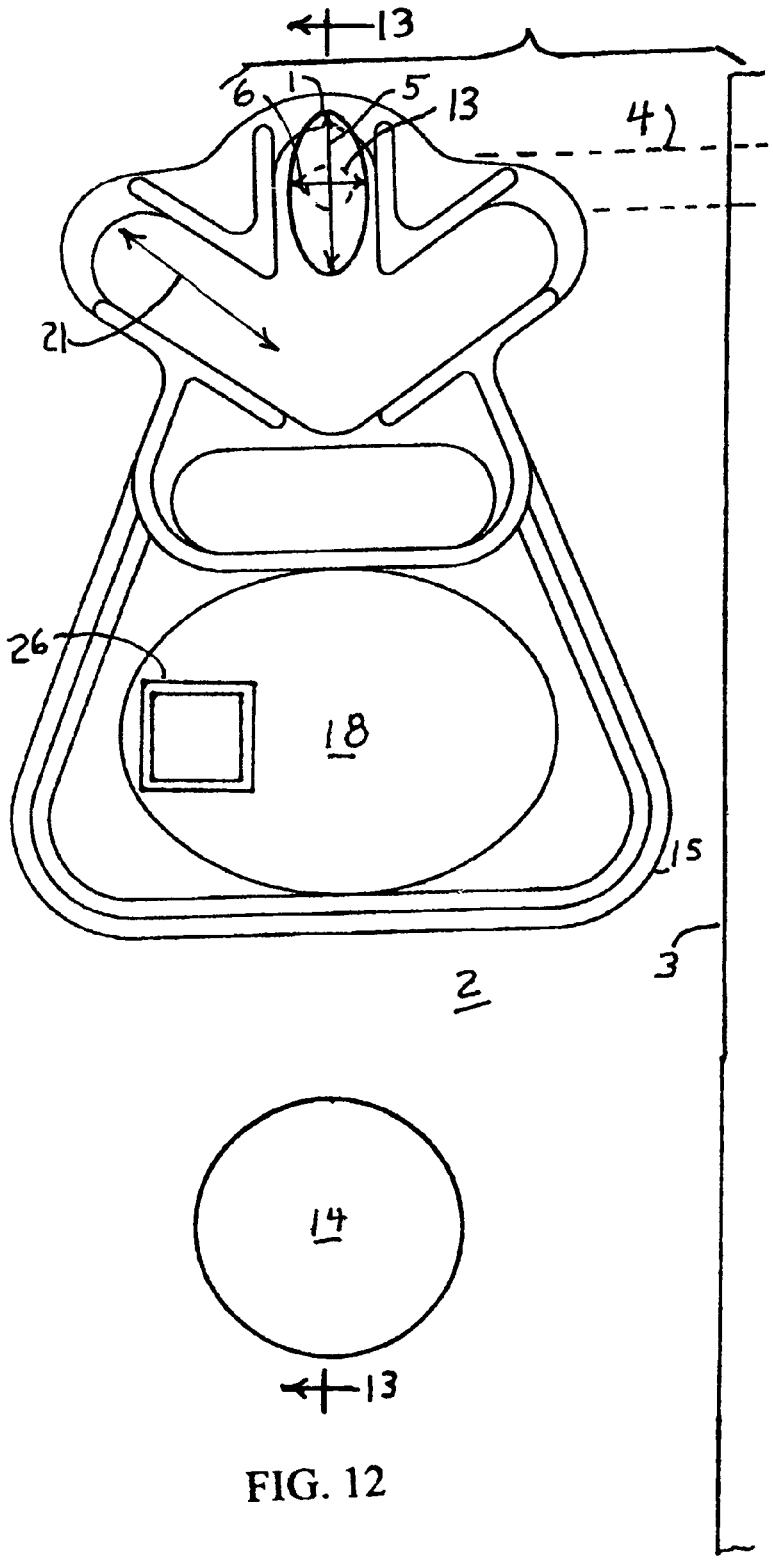
FIG. 12 is a front elevation view of the invention mounted on a door for use.
Figure 13:
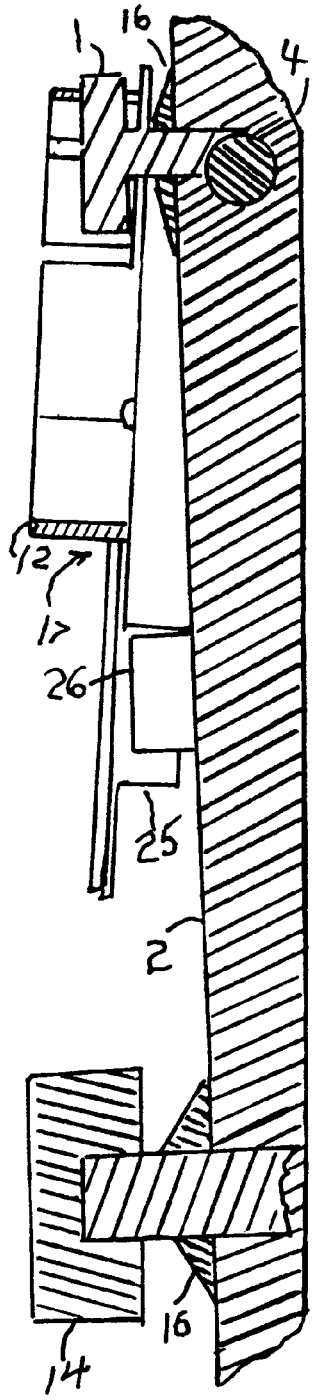
FIG. 13 is a sectional view taken through line 13-13 of FIG. 12.

Extending outwardly from the first broad face 23 are secondary members 25 adjacent the through aperture 18. In some situations, the bezel 16 on the door 2 at the knob 1 may be large enough to hold the apparatus 17 away from the surface of the door. When the door opens inwardly, and there is too little frame extending into the room to engage the second end 15, the secondary members 25 may engage the frame. If there is not enough frame extending into the room to be engaged by members 25, a projection 26, as shown in FIG. 12 may be affixed to the surface of the door to engage a secondary member to thereby stop rotation of the device before the deadbolt is retracted.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus to prevent rotation of a deadbolt knob on a door pivotally mounted in a door frame and having a door knob spaced apart from the deadbolt knob by a first distance to thereby prevent movement of a deadbolt connected to the deadbolt knob from a locked position, the deadbolt knob having a long first dimension and a shorter second dimension orthogonal to the first dimension, the apparatus comprising:

a) an elongate planar body having broad opposed first and second faces and a length less than said first distance;

b) a plurality of through passages at a first end of the body, the passages constructed and dimensioned to removably receive the deadbolt knob therein when the deadbolt is locked, and having side walls extending outwardly from the first face that are spaced apart a greater distance than the second dimension and a lesser distance than the first dimension so that the deadbolt knob cannot rotate freely within the passage;

c) a second end of the body constructed and dimensioned to engage the door frame as the deadbolt knob, when received in one of the passages, is rotated to prevent sufficient rotation of the deadbolt knob to unlock the deadbolt d) a through aperture in the second end for receiving the door knob for hanging the apparatus on the door knob for storage when not in use;

e) secondary members extending outwardly from the second broad face adjacent the through aperture, the secondary members adapted to engage the door frame as the deadbolt knob is rotated to prevent sufficient rotation of the deadbolt knob to unlock the deadbolt; and f) a projection adapted to be mounted on the door to engage a secondary member as the deadbolt knob is turned before the deadbolt can become unlocked.

2. Apparatus to prevent rotation of a deadbolt knob on a door pivotally mounted in a door frame and having a door knob spaced apart from the deadbolt knob by a first distance to thereby prevent movement of a deadbolt connected to the deadbolt knob from a locked position, the deadbolt knob having a long first dimension and a shorter second dimension orthogonal to the first dimension, the apparatus comprising:

a) an elongate planar body having broad opposed first and second faces and a length less than said first distance;

b) a plurality of through passages at a first end of the body, the passages constructed and dimensioned to removably receive the deadbolt knob therein when the deadbolt is locked, and having side walls extending outwardly from the first face that are spaced apart a greater distance than the second dimension and a lesser distance than the first dimension so that the deadbolt knob cannot rotate freely within the passage;

c) a second end of the body constructed and dimensioned to engage the door frame as the deadbolt knob, when received in one of the passages, is rotated to prevent sufficient rotation of the deadbolt knob to unlock the deadbolt;

d) a through aperture in the second end for receiving the door knob for hanging the apparatus for storage when not in use; and e) secondary members extending outwardly from the second broad face adjacent the through aperture, the secondary members adapted to engage the door frame as the deadbolt knob is rotated to prevent sufficient rotation of the deadbolt knob to unlock the deadbolt.

* * * * *